US005688086A

United States Patent [19]

Menzemer et al.

[11] Patent Number: 5,688,086

[45] Date of Patent: Nov. 18, 1997

[54] STANDARD CORNER FITTINGS FOR ALUMINUM CONTAINER FRAMES

[75] Inventors: Craig C. Menzemer, Murrysville; Andrew J. Hinkle, Plum Boro; William C. Herbein, Murrysville, all of Pa.; Daniel D. Roup, Davenport, Iowa; Ross E. Grimm, Tarentum, Pa.; David S. Bennett, Davenport, Iowa

[73] Assignee: Aluminum Company of America, Pittsburgh, Pa.

[21] Appl. No.: 601,312

[22] Filed: Feb. 16, 1996

[51] Int. Cl.[6] ..... B65D 61/00

[52] U.S. Cl. ..... 410/68; 410/44; 410/49; 211/182; 220/1.5; 403/231

[58] Field of Search ..... 410/68, 44, 82, 410/83, 120, 47, 49, 42; 211/182, 189; 220/1.5, 4.12, 562; 403/231, 217, 218, 170

[56] References Cited

U.S. PATENT DOCUMENTS

| | | | |
|---|---|---|---|
| 1,453,474 | 5/1923 | Mauran | 410/68 |
| 2,056,179 | 10/1936 | Fitch | 410/68 |
| 3,052,440 | 9/1962 | Bauer et al. | 410/44 |
| 3,459,326 | 8/1969 | Betjemann | 220/1.5 |
| 3,726,431 | 4/1973 | Botkin | 220/1.5 |
| 4,345,861 | 8/1982 | Aarseth | 410/68 |
| 4,614,278 | 9/1986 | Gerhard | 410/68 X |
| 5,580,181 | 12/1996 | Nomura | 403/231 X |

*Primary Examiner*—Karen B. Merritt
*Assistant Examiner*—Stephen Gordon
*Attorney, Agent, or Firm*—Elroy Strickland; Tracey D. Beiriger

[57] ABSTRACT

An elongated metal frame structure for connecting a large elongated container to a vehicle employed in transporting the container. The frame comprises a plurality of aluminum alloy tubes connected together at certain corners of the frame by corner assemblies. The assemblies comprise a "standard" cast iron or steel fitting and at least one steel member connected to one face of the fitting. The exterior surfaces of each steel member are coated with materials that are effective in electrically separating the steel member from an aluminum tube of the frame when the corner assemblies and aluminum tubes are assembled together. The size of the steel members in cross section with the materials applied to the surfaces of the steel member is such that the steel member can slip into the end of the aluminum tube located at a corner of the frame.

10 Claims, 2 Drawing Sheets

Figure 1:
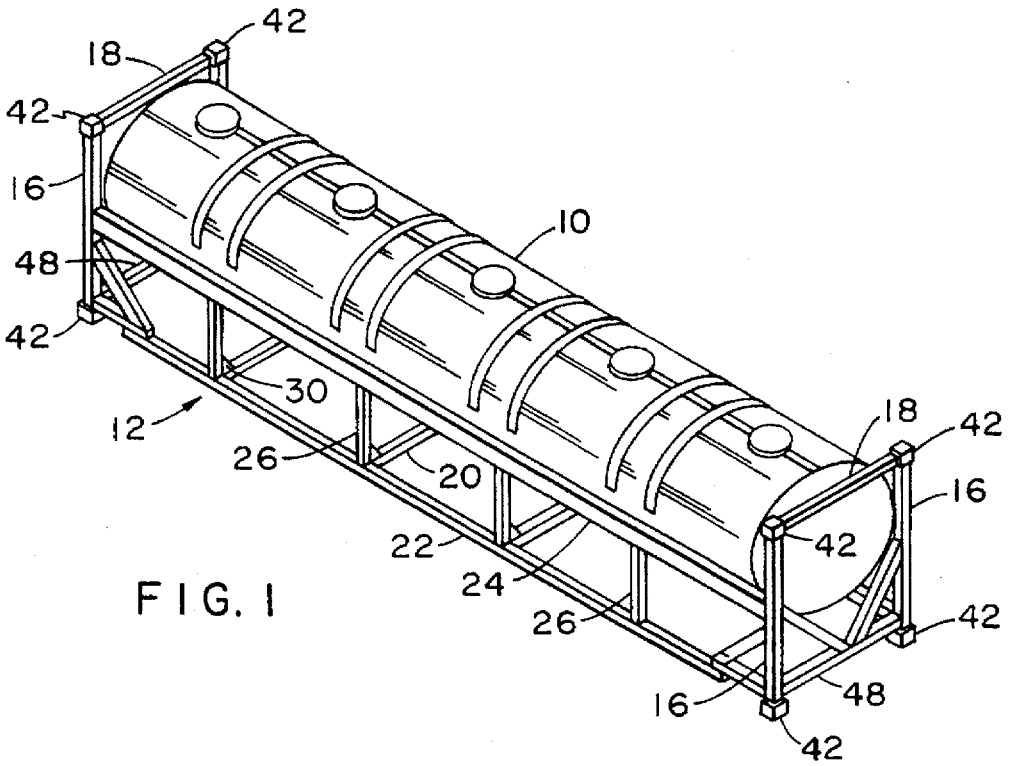

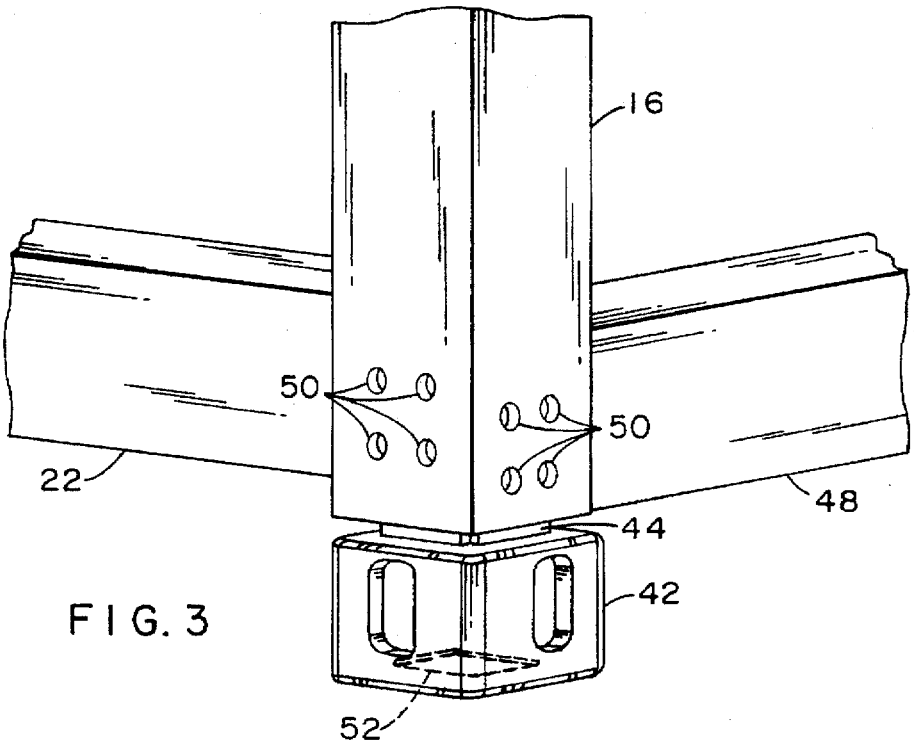
FIG. 3
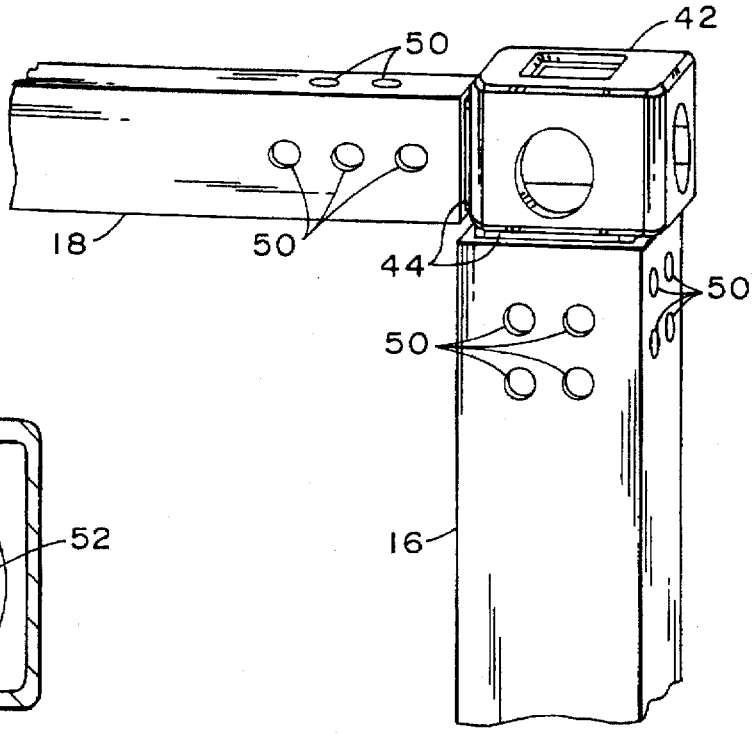
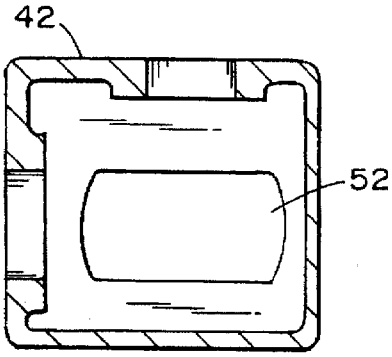
FIG. 5
(PRIOR ART)
FIG. 4

STANDARD CORNER FITTINGS FOR ALUMINUM CONTAINER FRAMES

BACKGROUND OF THE INVENTION

The present invention relates generally to elongated rectangular frames for transporting large elongated dry bulk containers, which frames are used to attach the containers to a transporting vehicle body. More particularly, the invention is directed to a frame made of hollow aluminum members connected together at certain corners of the frame by "standard" corner fittings.

The use of aluminum alloys in the primary structures of dry bulk container assemblies results in lighter weight and greater payload capacity than currently available steel technologies. Dry bulk containers per se require an elongated rectangular frame that must fit inside a specified ISO envelope (International Standard Organization) and use standard ferrous corner nodes to connect tubular members of the frame together. A difficulty arises when using such standard corner nodes with aluminum frames, i.e., material isolation of the steel and aluminum is needed to avoid sacrificial corrosion of the aluminum, particularly in salt air, that would be experienced, for example, on ocean-going vessels. Heretofore, ferrous frame members were welded directly to the nodes in constructing a frame.

The integrity of the corner connections is critical to the overall frame/container performance. In the case of ocean-going vessels, such dry bulk container frames are stacked eight-high, in contrast to trailer trucks where only a single high frame is employed. In rail cars, two such frames are used, one stacked upon the other. Thus, the structural integrity of the frame is critical, and a critical portion of the frame is the corner connections. In using ferrous corner nodes with aluminum frames, it is essential that the aluminum remain intact, which requires galvanic isolation of the aluminum and steel.

SUMMARY OF THE INVENTION

The present invention allows one to take advantage of the lightness of aluminum, in comparison to steel, while, at the same time, using ISO standard steel corner nodes to connect hollow aluminum frame components while simultaneously preventing or at least substantially reducing the occurrence of electrolytic action between the two metals, which have different electrochemical potentials. Such potentials can result in aluminum ions transferring to the steel.

Standard corner nodes comprise a generally square or rectangular parallelpiped cast iron or steel fitting. The present invention provides such nodes/fittings with steel members extending from respective faces of the nodes or fitting for reception into the ends of hollow aluminum tubes that form the frame for enclosing vessels designed for transporting material. In a preferred embodiment, the steel members extending from the cast fittings are sized and configured to slip into the ends of the hollow aluminum frame members after the steel members have been coated with layers of material that are effective in electrically separating the two metals. The coatings applied to the steel members are durable substances, as the environment can be harsh, i.e., the subject frames are used to connect large containers to truck beds, railroad cars or stacked in the holes of cargo ships. The International Standard Organization (ISO) prescribes the size of the frames, which in Europe are twenty and forty feet long, eight to nine and a half feet high, and eight feet wide. In the United States, the standards are somewhat different since the trailer size of the tracking industry and the car size of U.S. railroads are different from those in Europe. In any case, the size of the frames, and of course the dry bulk containers, is large, the roads and rails over which the equipment travels are not always smooth, and dry bulk material is shipped, of course, in all types of weather. Hence, the structural integrity of the frame is important.

Coating materials that have been found particularly useful in isolating the steel members from the aluminum tubular members of the subject frame include a standard non-lead primer for coating steel surfaces. The primer is applied to the steel members followed by several coats of a mixture of an aluminum paste pigment and varnish. The non-lead primer is electrochemically compatible with the steel, to which it is applied, while the mixture of the aluminum paste pigment/varnish is electrochemically compatible with the aluminum members. The non-lead primer and aluminum paste/varnish has been found to be electrochemically compatible.

Further isolation of the steel and aluminum is provided by use of a suitable tape or caulking-type sealant applied to the ends of the aluminum tubes of the frame and to surfaces of the steel members inserted into the tubes. The tape or caulking forms a seal that prevents the ingress of moisture and water into the ends of the tubes and about the shank of the steel members.

Both the aluminum tubes and the steel members are provided with openings for receiving fasteners that secure the two components together. The location of these openings in relation to the ends of the aluminum tubes spaces the ferrous cast fitting from the end of each tube to prevent physical and electrical contact between the fittings and tube ends. In this manner, another mechanism is provided for separating the ferrous and aluminum members.

Preferably, the fasteners are made of stainless steel or other materials that have an electrochemical potential lying outside of ranges that would provide ionic transfer. However, iron or steel fasteners provided with a galvanized coating will provide sufficient isolation between the fasteners and the aluminum.

THE DRAWING

Figure 2:
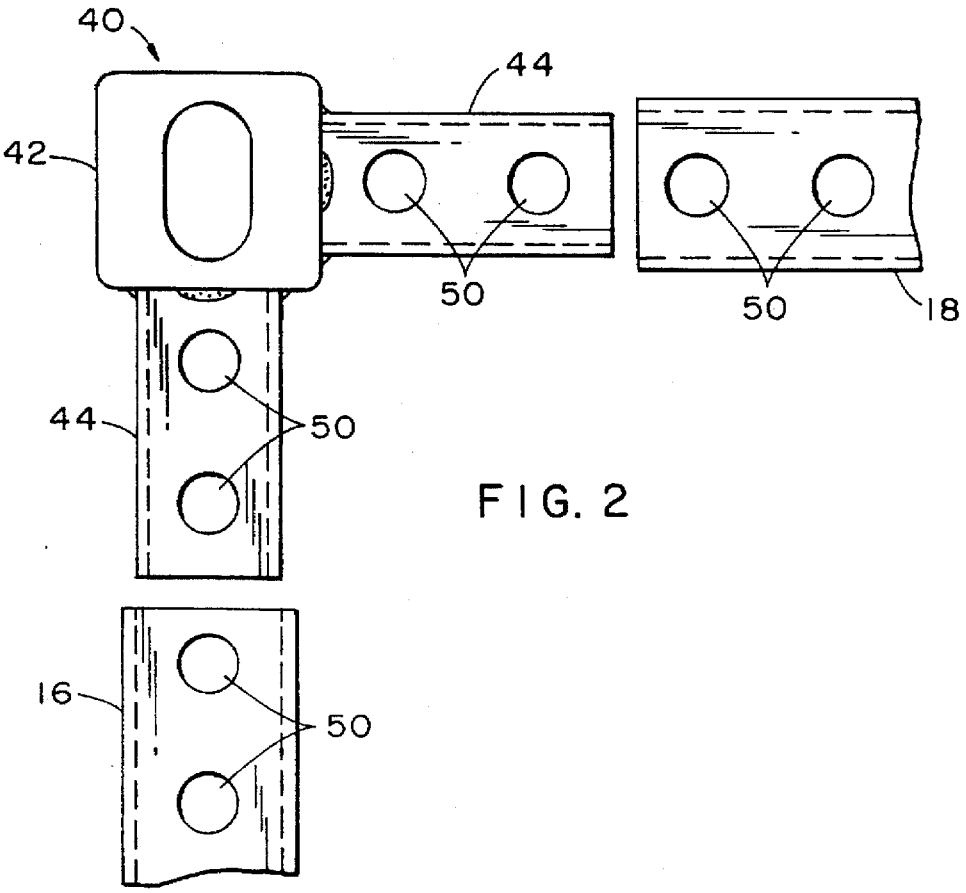

The invention, along with its objectives and advantages, will be better understood from consideration of the following detailed description and accompanying drawing, in which:

FIG. 1 is a perspective view of a dry bulk container located within an elongated frame for connecting the container to a transporting vehicle, FIG. 2 is an elevation view of an ISO corner assembly comprised of a cast fitting with two steel members extending therefrom for insertion into the ends of two aluminum frame members, only partially depicted, FIG. 3 is an isometric view of a hollow ISO bottom corner assembly inserted into a hollow vertical frame member, only partially shown, FIG. 4 is an isometric view of an upper ISO corner assembly inserted in two hollow frame members, again only partially shown, and FIG. 5 is a sectional view of the "standard" cast node.

PREFERRED EMBODIMENTS

Referring now to the drawings, FIG. 1 thereof shows in perspective an elongated vessel or container 10 for receiving and holding dry bulb materials, such as grain, starch, plastic pellets and alumina, located in an elongated rectangular aluminum frame 12. Frame 12 is employed to secure container 10 to the bed of a truck or rail car (not shown). In addition, such frames are secured in the holes of ocean-going vessels, as noted earlier. The frame is secured to the transporting vehicle by lower cast corner fittings 42 (FIG. 3) in a manner discussed hereinafter.

In FIG. 1, frame 12 includes four vertical upstanding corner members 16 located at front and rear corners of the frame, two upper cross members 18, a plurality of lower cross members 20 extending beneath vessel 10 that connect together two lower longitudinal rails or members 22, only one being visible in FIG. 1. Two upper longitudinal members 24 are located above longitudinal members 22 on opposed sides of vessel 10, again only one of these members being visible in FIG. 1. Upper and lower longitudinal members 22 and 24 are connected together by a plurality of vertical members 26. Cross members 20 and vertical members 26 can be welded to the longitudinal members using gussets 30.

The members of frame 12 are hollow and are made of high strength durable aluminum alloy materials. A preferred heat treated alloy is 6061-T6 though other high strength alloys can be used. A preferred form of manufacture is by extrusion, though the members of the frame can be made by processes other than extruding, such as drawn aluminum tube, for example.

The upper forward and rear corners of frame 12 are connected together by four hollow corner assemblies 40 of the invention. As seen in FIGS. 2 and 4, each assembly is comprised of a standard cast iron or steel fitting 42 and at least two steel members 44 extending from, respectively, two sides or faces of the fittings at right angles to each other. If a longitudinal hollow rail extended between the corner assemblies 40 along the upper sides of tank 10 in FIG. 1, a third member 44 would be provided on a third face of fitting 42 extending in the direction of the third rail and perpendicular to the members for seating in corner posts 16 and cross members 18.

The lower corners of frame 12 are provided with corner assemblies again comprised of a standard cast fitting 42 and only one steel member 44, as seen in FIG. 3, extending upwardly into aluminum corner posts 16. A lower cross member 48 extends between the posts and can be welded to the lower end of the corner posts, as opposed to being connected to the posts by corner assemblies 40, as certain clearances are needed beneath cross members 48. Otherwise, such cross members could be connected to the corner posts by extensions 44 of corner assemblies 40. The lower fitting 42 secures frame 12 to the bed or deck of the transporting vehicle by a fastening device (not shown) that extends into an elongated opening 52 of the fitting from the bed or deck, which device is then rotated to seat over and engage a wall area located about the opening.

Steel members or extensions 44 can be a solid bar having one end welded to a face of cast fitting 42. A solid bar, however, is heavier than a hollow member, and would thus add weight to the overall apparatus of frame 12. Preferably, member 44 is hollow, such as that provided by a drawn steel tube, for example, with one end thereof welded to one face of casting 40. Another construction for member 44 includes four steel plates welded together along seams formed by adjacently disposed plates, and one end of such a structure welded to one face of casting 42. In either case, a shank is formed for insertion into the ends of the aluminum tubular frame members 16 and 18 after suitable isolating layers of material are applied to the surfaces of shanks 44.

Members or shanks 44 of the corner assemblies 40 are coated with durable, generally non-compressible substances (not shown in the drawings) that electrically isolate the steel of 44 from the aluminum metal of frame members 16 and 18. A preferred material includes at least one layer of a non-lead primer painted on the surface(s) of member 44. After the primer dries, an initial layer of a mixture of aluminum paste pigment and varnish is applied to the primer. Several such paste/varnish layers are then applied to the initial layer of pigment and varnish, after each layer dries. Though the primer paste/varnish combination is preferred, other suitable combinations and compositions can be used.

Similarly, though the tube ends of the frame are sized to receive steel members 44, the frame member can be sized to fit into the hollow of the steel members.

When the coating process is completed and the layers set, the corner assemblies 40 are ready for use. The size of each member 44 with the layers is such that 44 slips into the hollow ends of frame members 16 and 18. The coatings and layers electrically isolate the steel and aluminum metal of the members such that the aluminum is not deteriorated by aluminum ion transfer to the steel. In addition, when the steel and aluminum are fastened together, the coatings and layers do not compress under the force of fasteners such that the separation effected by the coatings and layers is not compromised.

The inside of aluminum members 16 and 18 and the shank of steel members 44 can be kept dry by caulking or tapping the ends of aluminum members 16 and 18 to members 44, thereby preventing the entry of water and moisture into the ends of the aluminum tubes. Again, the general absence of water and moisture in the overlapping area of the steel and aluminum limits substantially galvanic action between the steel and aluminum.

The hollow shank 44 of corner assemblies 40 and the ends of frame members 16 and 18 are provided with a plurality of openings 50 sized to receive suitable fasteners (not shown) to secure the corner assemblies and frame members together. The number of openings is not critical except that a minimum number is needed to insure proper fastening of the members together. What is needed are identical patterns or configurations of openings in the shank and frame members such that the openings can be aligned for the reception of fasteners.

A preferred fastener is a stainless or galvanized steel blind fastener similar to the well-known pop rivet but high in strength and durability. Such a fastener does not pass completely through the members; rather, it enters only through aligned openings 50 in a first wall of each of the members, then reformed inside of the hollow shank 44 immediately behind the first wall thereof, when outwardly pulled, without reaching the opposite walls of the shank and frame members. In this manner, the two members can be quickly fastened together in a high strength manner using a minimum number of fasteners that limits areas of contact between the fasteners, corner assemblies and frame members.

The openings 50 provided in shanks 44 and frames 16 and 18 are located in a manner that when the two are fastened together, cast nodes 42 are spaced from the ends of frame members 16 and 18 to prevent physical and electrical contact between the ferrous material of the nodes and the aluminum material of the frame members. This is seen in FIGS. 3 and 4 of the drawings and provides another means for electrically separating the ferrous and aluminum members.

What is claimed is:

1. A metal frame structure for connecting a container to a vehicle employed to transport the container, said frame comprising a plurality of aluminum alloy tubes connected together at corners of the frame by corner assemblies, each said corner assembly comprising at least one steel member connected to a standard cast iron or steel corner fitting, with said at least one member having surfaces coated with materials that are effective in electrically separating each said steel member from the aluminum tubes when the corner assemblies and aluminum tubes are assembled together, each said member including the electrically separating material and respective said assembled tubes being relatively sized to slip one upon the other at the frame corners.

2. The metal frame of claim 1 in which the container is a vessel for holding dry bulk material.

3. The metal frame of claim 1 in which the separating materials on the steel members comprise:

a base material of a non-lead primer; and a plurality of coats of a mixture comprised of aluminum paste pigment and varnish applied over said base material.

4. The metal frames of claim 3 in which the corner assemblies and aluminum tubes are sealed with an electrically insulating tape or caulking material applied to the steel members and to the ends of the aluminum tubes receiving the steel members.

5. The metal frame of claim 1 in which each steel member has a tubular configuration in cross section, with one end thereof welded to one face of the respective attached cast fitting.

6. The metal frame of claim 1 in which the steel members of the corner assemblies comprises steel plates welded to the respective cast fitting and to each other to form a hollow member extending from the respective cast fitting, and insertable in an end of a respective said aluminum tube at a respective said corner of the metal frame.

7. The metal frame of claim 1 in which the steel members of the corner assemblies are drawn tubes having one end welded to one face of the respective attached cast fitting.

8. The metal frame of claim 1 in which the steel members and aluminum tubes are connected together by fasteners inserted into openings provided in the steel members and aluminum tubes and secured in the steel members.

9. The metal frame of claim 8 in which the openings provided in the steel members and aluminum tubes are located in a manner that spaces the cast fittings from the ends of the aluminum tubes when the fasteners are inserted in said openings.

10. The metal frame of claim 1 in which the steel members with the electrically separating materials are sized to slip into hollow ends of the aluminum alloy tubes.

* * * * *